United States Patent [19]

Lamoreaux

[11] 4,293,281

[45] Oct. 6, 1981

[54] MOBILE AIR CHARGING SYSTEM

[76] Inventor: Charles L. Lamoreaux, 28012 Santona Dr., Rancho Palos Verdes, Calif. 90274

[21] Appl. No.: 135,357

[22] Filed: Mar. 31, 1980

Related U.S. Application Data

[63] Continuation of Ser. No. 29,740, Apr. 13, 1979, abandoned, which is a continuation of Ser. No. 766,081, Feb. 7, 1977, abandoned.

[51] Int. Cl.[3] ..... F04B 49/10

[52] U.S. Cl. ..... 417/9; 417/44; 417/319; 417/374

[58] Field of Search ..... 417/374, 9, 16, 17, 417/15, 34, 44, 63, 319; 73/29, 23, 27 R

[56] References Cited

U.S. PATENT DOCUMENTS

| | | | |
|---|---|---|---|
| 1,012,821 | 12/1911 | Cutler | 417/44 |
| 2,219,472 | 10/1940 | Defandorf et al. | 417/16 X |
| 2,421,872 | 6/1947 | Evelyn | 417/34 X |
| 2,463,703 | 3/1949 | Legler | 417/44 X |
| 2,552,518 | 5/1951 | Churchmann | 417/44 X |
| 2,720,087 | 10/1955 | Groene | 417/15 |
| 2,725,825 | 12/1955 | Cibattari | 417/374 X |
| 2,733,661 | 2/1956 | Surgi | 417/319 X |
| 3,046,368 | 7/1962 | Kaminky | 417/44 |
| 3,211,365 | 10/1965 | Phelps | 417/374 X |
| 3,922,115 | 11/1975 | Coe et al. | 417/374 |

*Primary Examiner*—Carlton R. Croyle
*Assistant Examiner*—Edward Look
*Attorney, Agent, or Firm*—Henry M. Bissell

[57] ABSTRACT

A compressor system which may be mounted for mobile use including dual power systems for driving the compressor. An electric motor is located in driving relationship to the compressor so that air is compressed when the rotor shaft of the motor is rotated. Rotation of the rotor shaft may be accomplished either by energizing the stator of the motor or by driving the rotor directly from an associated engine, coupled thereto by means of an electromagnetic clutch. If desired, the engine may also be utilized to drive a generator in order to provide electrical power to other devices. The control circuit may include safety interlocks which prevent energization of both the electric motor and the electromagnetic clutch simultaneously. Other safety devices may also be employed to disconnect power from the motor and the clutch, as necessary, if certain contaminants are sensed in the compressed air, to shut off the engine for over-limit conditions of temperature, air pressure, and the like.

11 Claims, 6 Drawing Figures

MOBILE AIR CHARGING SYSTEM

This is a continuation of application Ser. No. 29,740, filed Apr. 13, 1979, now abandoned, which is itself a continuation of application Ser. No. 766,081, filed Feb. 7, 1977, now abandoned.

BACKGROUND OF THE INVENTION

1. Field of the Invention

This invention relates to air compressor systems and, more particularly, to such systems utilized for pressurizing air bottles for firefighters, emergency crews and the like.

2. Description of the Prior Art

In the field of emergency service equipment, it is often impossible for the emergency personnel to know whether or not electrical power will be available, for example, at the scene of a fire or accident. However, since an electric motor is normally significantly more efficient than a fossil fuel-engine, it is usually preferable to drive emergency equipment with electrical power if possible. Further, it is undesirable to generate the noise and exhaust pollutants which are usually inherent in small, portable engines, since they usually add to the confusion at the scene of an emergency, as well as to reduce the efficiency of the personnel present.

One example of such emergency service equipment is an air compression system for portable breathing devices. In many emergency situations, it is imperative that firemen and other service personnel have a source of oxygen for breathing in areas filled with smoke and/or noxious fumes so that they can continue to combat the emergency under those conditions. In the past, it has been the practice for these personnel to bring a number of pressurized air bottles to the scene of an emergency so that such breathable air would be readily available during an emergency. While this is normally quite satisfactory for relatively small fires, etc., it may not suffice for fighting large structural fires, for example, when air may be required for breathing under such conditions for a long period of time and/or by a large number of personnel.

Accordingly, it has become desirable and necessary to provide a simple and compact unit which may be employed on an immediate basis in order to provide compressed air for charging air bottles which may be used by emergency personnel. Further, it is preferable that such apparatus be readily portable to the scene of an accident, fire or other emergency, be operable with a minimum of operator training, and have the option of being driven by electric mains power or a self-contained engine.

SUMMARY OF THE INVENTION

The present invention relates to a mechanical drive system which may be powered through one of at least two sources of power, utilizing the minimum possible quantity of hardware and other mechanical connection elements.

In the presently preferred embodiment, apparatus for use at an emergency location may be mounted on a trailer, a truck bed, or even a skid for movement by a helicopter or other transport. In any event, for the sake of illustration of the present invention, it will be presumed that the machine being driven is a compressor which may be mounted, if desired, on such a mobile unit for transport. Of course, any other machine may be driven by a comparable system, if desired. Similarly, the compressor of this example may be operatively connectable to one or more charging receivers in which compressed air may be stored until the time that an air bottle is to be charged.

The compressor is mechanically coupled to the shaft of an electric motor so that the compressor may be driven thereby when the motor is energized. The motor is typically designed for standard electric mains power, usually 110 to 120 volts AC and, when such is available at the site of an emergency, the compressor will be powered by the electric motor. Apparatus in accordance with the present invention also includes an internal combustion engine having its shaft in line with the rotor shaft of the motor and coupled thereto by a selectively energizable electromagnetic clutch so as to develop the capability of driving the compressor by driving the rotor shaft. Thus the compressor system may be operated where electric mains power is not available. Flexible couplings are included along the engine shaft-clutch-rotor shaft so as to compensate for any slight misalignments of the axes of the engine output shaft and the rotor shaft.

In order to prevent damage to either the internal combustion engine or the motor which might occur if the motor were energized at the same time that the engine was running, it is preferred that the overall system include one or more safety interlocks which will positively prohibit actuation of the electromagnetic clutch at the same time that the motor is energized. Thus, one of the power sources for the compressor must be disconnected at any given moment.

Under certain circumstances, it may be desired that the internal combustion engine be utilized for other outputs when the motor is energized to drive the compressor. In such a case, the portable unit may also be provided with a second machine, such as a generator, which may be directly driven by the engine. The generator may either be connected to the engine by a clutch or else a safety relay system may be utilized to prevent the use of any current from the generator when the engine is operatively connected to the rotor shaft. This expedient may be utilized to prevent an overloading of the engine and/or a loss of efficiency of the principal load device which, in the preferred embodiment, has been designated to be a compressor.

In addition to electrical circuitry which may be employed to prevent both compressor drive sources from being activated at the same time, it may also be preferable in some instances to provide motor and engine controls which are so distant from one another that it is impossible for an operator to actuate both simultaneously. This can be accomplished, for example, by providing the control switches, etc., for each on opposite sides of the mobile unit.

If the primary device to be powered is an air compressor, those skilled in the art of breathing devices will be aware of the fact that it is imperative that certain filtration chemicals be employed through which the compressed air is passed in order to eliminate bothersome and/or dangerous impurities or pollutants. One indication of whether or not the chemicals in the associated filtration system are operating properly can be found in the dew point of the compressed air, i.e., the amount of water vapor or moisture in the air which has been compressed, since one of the functions of the filtration system is to remove water vapor from the air being compressed.

Similarly, it is imperative that the carbon monoxide content of the compressed air be minimized, if not eliminated entirely, to prevent any danger to the person utilizing the air in the bottle.

Consequently, it is preferred that the present invention employ dew point and carbon monoxide sensors in the compressed air line, i.e., downstream from the compressor. Then, if the sensors should be actuated at predetermined levels of such contaminants, they may be utilized to energize signaling devices, as well as to shut off the power to the motor and to the electromagnetic clutch, thereby preventing the compressor from being operated until the dangerous condition is corrected.

BRIEF DESCRIPTION OF THE DRAWINGS

A better understanding of the present invention may be had from a consideration of the following detailed description; taken in conjunction with the accompanying drawing, in which.

DESCRIPTION OF THE PREFERRED EMBODIMENT

Figure 1:
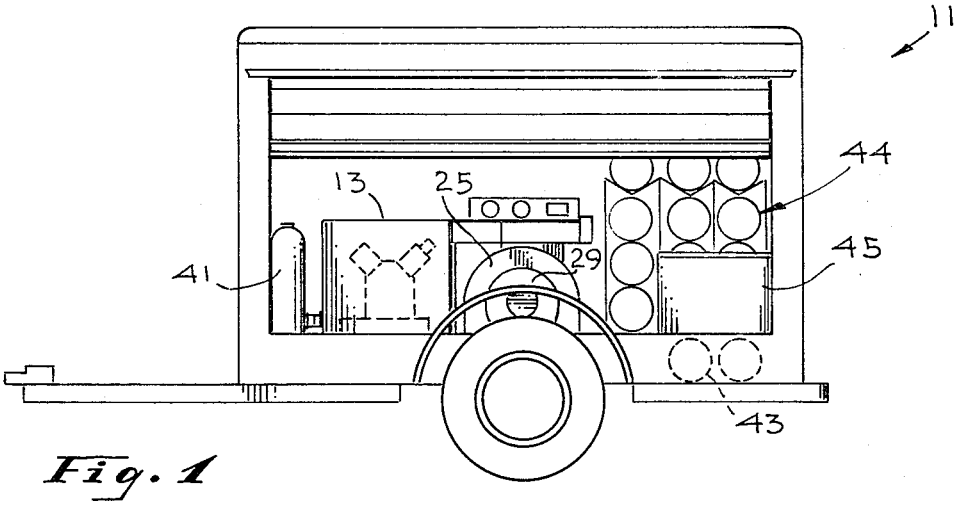
FIG. 1 is a side elevation of a mobile unit including one particular arrangement in accordance with the present invention.
Figure 2:
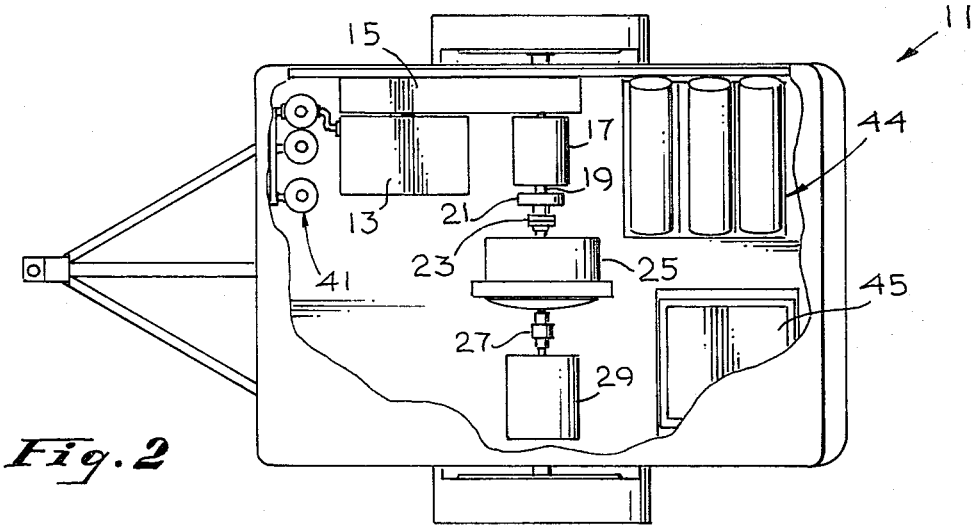
FIG. 2 is a top plan view, partially broken away, of the mobile unit shown in FIG. 1.
Figure 3:
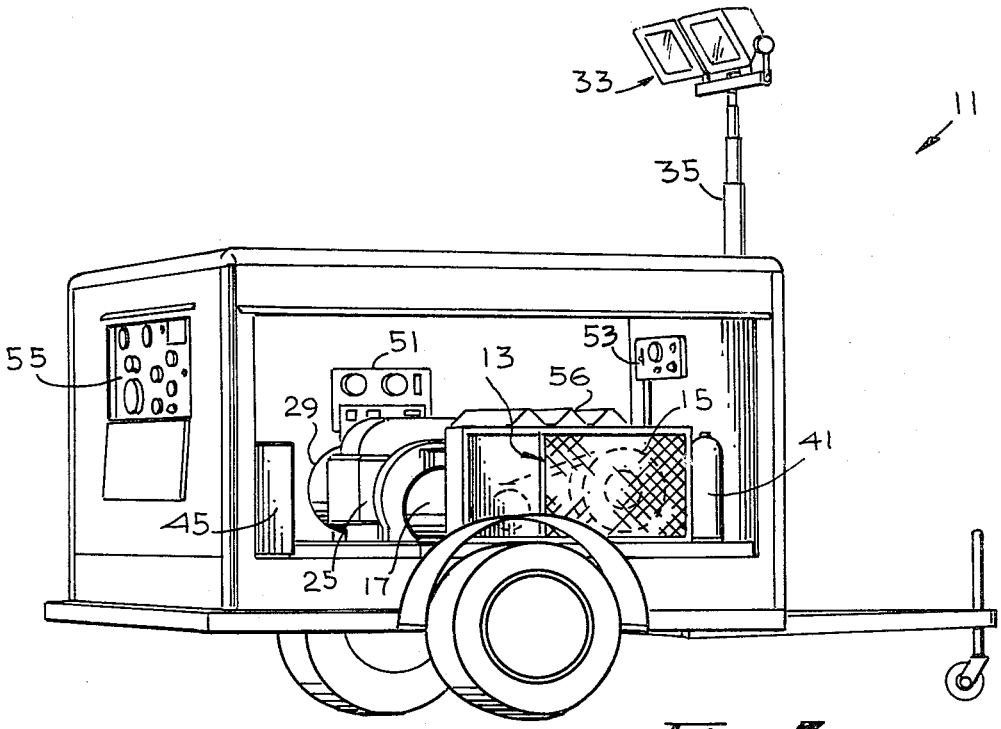
FIG. 3 is a perspective side view of an embodiment similar to the mobile unit shown in FIG. 1, as seen from the opposite side of the unit.

Referring now to FIGS. 1–3, it can be seen that the present invention is illustrated as being mounted upon a trailer 11. Although it is envisioned that the present invention will find its most frequent use on such a trailer, those skilled in the art will realize that the invention might just as easily be mounted in the bed of a pickup truck, on a skid which might be moved by a helicopter, or even in a fixed location in which continuous availability of electrical power is uncertain.

In any event, and with particular reference to FIGS. 1–3, and 6 the system shown therein includes a compressor 13 coupled through a well-known belt and pulley system 15 to the rotor shaft 19 of an electric motor 17. The rotor shaft 19 is provided, at one end thereof, with one or more pulleys to drive belts 15. The opposite end of the shaft 19 is coupled through a normally disengaged electromagnetic clutch 21 and a flexible coupling 23 to an internal combustion engine 25.

With the structure described thus far, it will be apparent that the compressor 13 may be driven by the motor 17 when the motor 17 is energized from standard electric mains. However, if there is no power available, due to an outage, remote location, etc., the electromagnetic clutch 21, which might be of any suitable type, may be activated so that the internal combustion engine 25 can power the compressor 13 by driving the rotor shaft 19 directly.

Referring specifically to FIGS. 1 and 2, it is shown that the engine 25 may also act, through a second flexible coupling 27, if desired, to provide power to a driven rotary device 29, such as a generator which may be utilized as a source of electrical power. For example, such a generator may be utilized to provide electrical power to a pair of floodlights 33 (FIG. 3) mounted on a light tower 35 on the trailer 11. Of course, the generator may be utilized to provide electrical power to any desired system, or the device 29 may comprise a water pump or some other auxiliary system may be coupled to be driven by the auxiliary output shaft of the engine 25 when electric mains power is available to energize the motor 17 to drive the compressor 13 therefrom.

As shown in FIGS. 1 and 2, a filtration system 41 may also be provided to eliminate certain contaminants from the air being compressed by compressor 13. If desired, one or more receiving tanks 43 may be provided to receive and store the air from the compressor 13 and the filtration system 41 at high pressure for use in charging individual gas bottles, 44, shown stored in racks ready for use or filling. For this latter purpose, a filling tank 45 may be provided which may be substantially filled with water when in use. When a bottle is to be charged, it may be placed into the tank 45 and a filling hose or line (not shown) attached to it. The opposite end of the filling hose is coupled through valves 59 (FIG. 4) to the storage receiver 43 and the compressor 13.

Referring to FIG. 3, it can be seen that the filling tank 45 is mounted in a slightly different position from that illustrated in FIG. 1 and 2, for the purpose of illustrating that the particular relative locations of the various structures is not deemed to be critical. In this same regard, it can be seen that, on the interior of the trailer 11, a pair of individual auxiliary control panels 51 and 53 may, if desired, be provided for controlling the engine 25 and the motor 17 respectively. The main control panel 55 is provided at the rear of the vehicle. Of course, these control panels may be located in any positions desired but in the preferred embodiment, they are spaced remotely from each other so that an operator can have access to only one control panel at a time. Also shown in FIG. 3, a bottle storage rack 56 may be provided, if desired.

Figure 4:
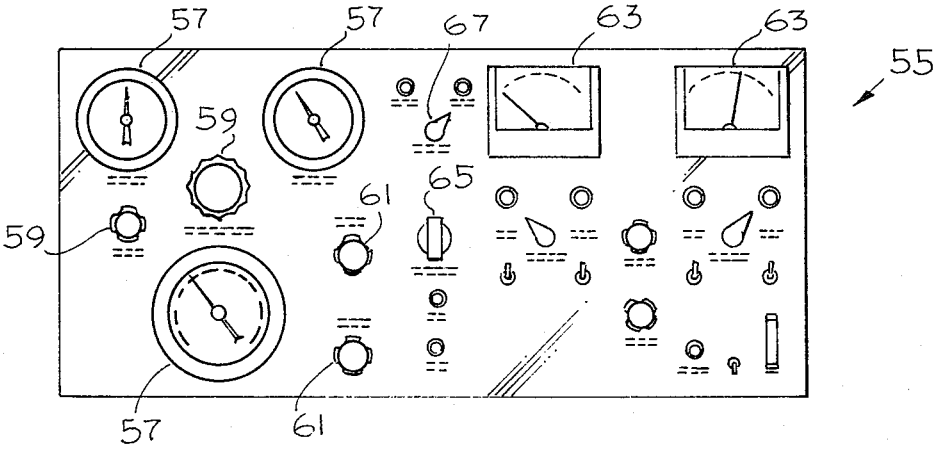
FIG. 4 is an elevation of that portion of the rear of the mobile unit shown in FIGS. 1–3 comprising the main control and instrument panel.

Turning now to FIG. 4, the main control panel 55 may include a plurality of gauges 57 for accurately determining the pressure of the compressed air at various points in the system. Similarly, the panel may be provided with a plurality of control valves 59 for controlling the connections between the receiver 43, compressor 13, and air bottle in the filling tank 45 to direct the flow of compressed air. As one safety feature of the present invention, a pair of valves 61 may be provided on the control panel 55 to operate the fill lines at the filling tank. For example, these valves 61 may be normally biased to the closed position but may be manually opened until they are released. This or a similar provision will prevent the operator from remaining at the filling tank when the bottles are initially pressurized and thus provide him with additional safety. Experience has shown that gas bottles are most likely to rupture and explode at the time that filling is initiated. Thus, in use, the operator would put the bottle into the filling tank, attach the filling hose to it, and then step to the rear of the vehicle and open the proper valve 61. Also the valves 59 may be set to isolate the receiver 43 from the rest of the system and connect the bottle being filled directly to the outlet of the compressor filtration system 41 so as to expedite filling of the bottles to full pressure when the receiver 43 is depleted.

If desired, one or more monitors or meters 63 may be provided for detection of various contaminants in the compressed air, such as carbon monoxide, moisture, etc. These meters may be preset so that when contaminants reach predetermined levels, alarms can be actuated in the form of sirens, lights, etc., and the system can be shut down. The system may also be provided with an emergency system shut-down switch 65 so that the entire system may be shut off instantaneously when the operator detects an emergency, regardless of which drive system he is using to power the compressor at that time. Similarly, a selector switch 67 may be provided to control a relay system so that the operator may select either the engine 25 or the motor 17 to drive the compressor 13.

Various other test, information, and control devices may be provided on the control panel 55 as desired, depending upon the specific machinery to be controlled, etc.

Figure 5:
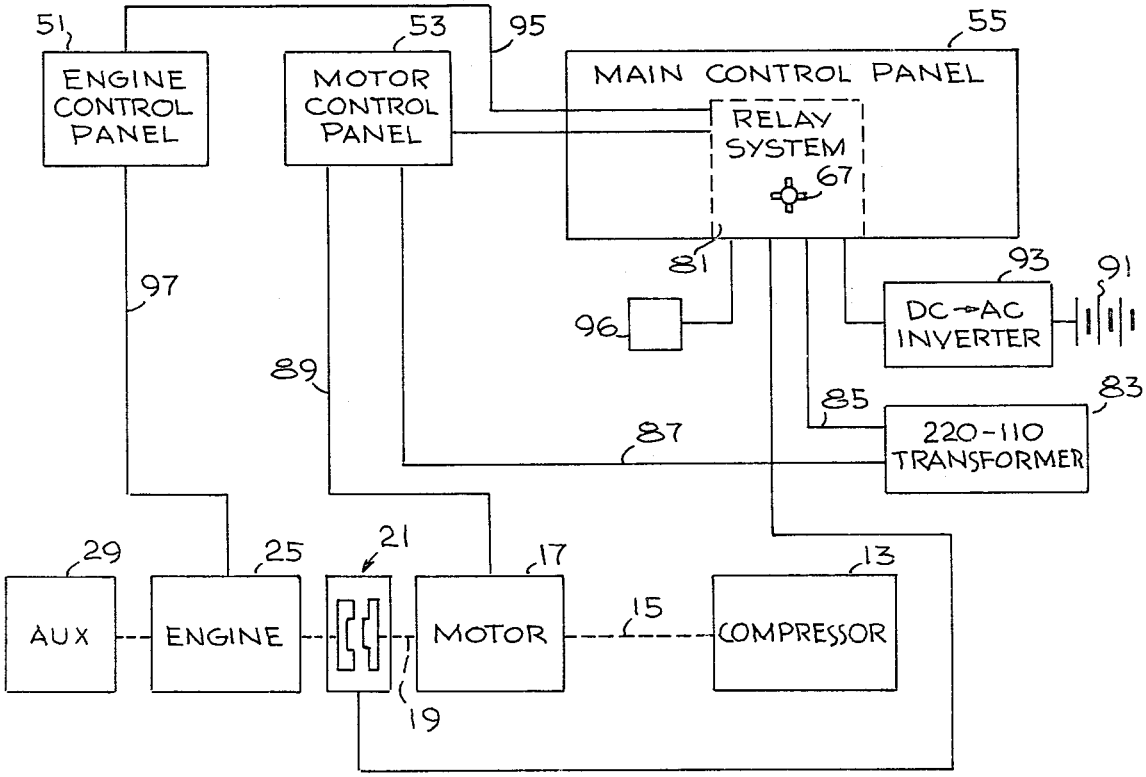
FIG. 5 is a simplified line diagram illustrating the cooperative relationship between electrical and mechanical elements which may be employed in the preferred embodiment of the present invention.
Figure 6:
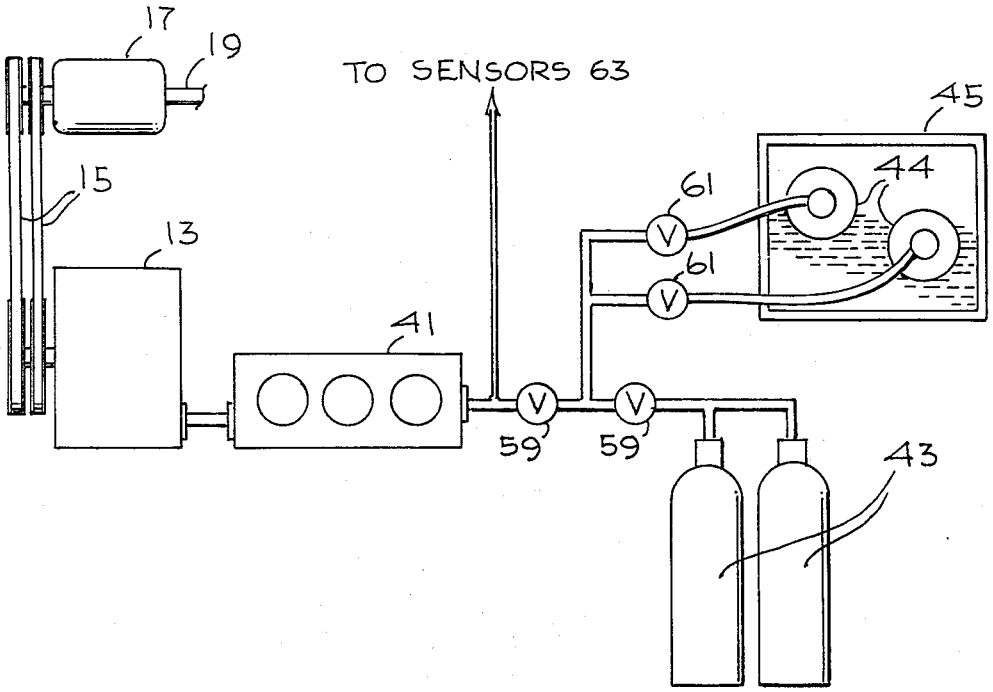
FIG. 6 is a schematic block diagram showing further details of the arrangement of FIGS. 1–3.

Referring now to FIG. 5, it can be seen that the main control panel 55 may cooperate with a relay system 81, at least a portion of which may be controlled by the selector switch 67. When an operator determines that the motor 17 should be utilized to drive the compressor 13, he may attach a 220 volt line to an entry circuit 83 which, if desired, may include a transformer which passes 110 volts to the relay system 81 through a line 85 and 220 volts to the motor control panel 53 through a line 87. The operator may then actuate the relay system 81 by turning the selector switch 67 to the electrical power position, and then walk around the vehicle to actuate the motor control panel 53 so that a line 89 to motor 17 is energized.

When the operator turns the selector switch 67 to the electrical power position, the relay system 81 may automatically open the electrical path to the electromagnetic clutch 21, thereby maintaining the positive separation of the rotor shaft 19 from the drive shaft of the engine 25 and preventing the engine shaft from being driven by the electric motor 17.

On the other hand, if the operator should desire to drive the compressor 13 from the engine 25, for example when electric mains power might not be available, he may actuate the relay system to an engine power position by turning the selector switch 67. This permits energization of the clutch 21 but prevents energizing the motor 17. When the operator accomplishes this, in the illustrating embodiment, he may automatically connect a battery 91, acting through a direct current-to-alternating current inverter 93, to the relay system 81 for transmission of starting power to the engine control panel 51 through a line 95, as well as actuating clutch 21. Subsequently, the operator may walk around the engine side of the vehicle and actuate the engine control panel 51 to deliver an engine starting signal to the engine 25 through a line 97.

Of course, the line diagram of FIG. 5 is quite simplified from that which might be used in any commercial embodiment of the present invention. For example, a commercial embodiment may well include signaling and shut-down devices which cooperate with the relay system 81 when contaminants are present in the compressed air, the chemicals in the filtration system need to be changed, the compressor is malfunctioning or is low on lubricating oil, etc. Such might be accomplished, for example, by the use of a sensor 96 (such as, for example, the monitor 63 of FIG. 4), responsive to such conditions and shown coupled to the relay system 81 (FIG. 5) which controls energization of the electric motor 17 and clutch 21, thus protecting the compressor and insuring against providing impure compressed air.

In any event, added features such as these, as well as many alternative embodiments of the present invention, will now be apparent to those skilled in the art. Although many such embodiments may not physically resemble that illustrated and described here, it should be kept in mind that the present invention is not defined by the illustrated embodiment, but rather by the following claims.

What is claimed is:

1. A compressor system coupled to be driven by a selected one of alternative power sources comprising:

a compressor;

an electric motor having a rotor shaft extending therethrough and having coupling means at both ends thereof, the rotor shaft being coupled via a first one of the coupling means to drive the compressor;

first means for selectively energizing the motor;

an internal combustion engine mounted in driving relationship with the rotor shaft, said engine being selectively operable independently of said rotor shaft;

second means including an electromagnetic clutch for selectively coupling the engine to the rotor shaft via a second one of the coupling means at the end of the rotor shaft remote from the first coupling means to drive the compressor via said rotor shaft, the clutch being engageable independently of the engine to couple the engine and the rotor shaft together; and independent manually operable electrical switching means coupled respectively to the first and second means for selectively activating one and only one of the first and second means at a time and for disabling the clutch from engagement at all times except when the engine is to be operated to drive the compressor.

2. The system of claim 1 further including first interlock means for preventing actuating of the second means when the motor is energized.

3. The system of claim 1 further including second interlock means for preventing the energization of the motor when the second means is actuated to operatively connect the engine to the rotor shaft.

4. The system of claim 1 wherein the switching means further includes a first auxiliary manually operable control means mounted adjacent the motor for controlling said motor, and second auxiliary manually operable control means mounted adjacent the engine for controlling said engine, the first and second auxiliary control means being spaced remotely from each other and from the interlock means.

5. Apparatus for charging bottles with compressed air comprising:

a compressor;

a receiver connected to the compressor for storing air compressed by said compressor;

sensing means for providing a control signal in response to the presence of contaminants above a predetermined level in air compressed by said compressor;

an electric motor having a rotor shaft extending through said motor for coupling at opposite ends of the shaft;

means coupling the rotor shaft at one end to said compressor in driving relationship;

an internal combustion engine which is operable independently of said rotor shaft;

electromagnetic clutch means for selectively connecting said engine to the other end of said rotor shaft to drive the latter and thus to drive said compressor therethrough, the clutch means being engageable independently of the engine to couple the engine and rotor shaft together;

independent manually operable electrical switching means coupled respectively to the electric motor and the electromagnetic clutch means for selectively activating one and only one of the electric motor and the clutch means at a time and for disabling the clutch from engagement at all times except when the engine is to be operated to drive the compressor; and means for shutting off electrical power to said motor and the selectively connecting means upon receipt of a control signal from the sensing means indicating contaminants above predetermined levels in air compressed by said compressor.

6. The apparatus of claim 5 including means for supporting an air bottle to be charged with compressed air by said apparatus, and manually operable means physically separated from said supporting means for controlling the charging of said air bottle.

7. The apparatus of claim 6 further including first valve means for coupling the air bottle to the receiver for transferring compressed air from the receiver to the bottle and second valve means for isolating the receiver and coupling the air bottle directly to the compressor filtration system.

8. An air compressor system comprising:

a compressor;

a receiver operatively connected to said compressor for receiving air compressed by said compressor;

an electric motor including a double-ended rotor shaft having one end operatively connected to said compressor to transmit power thereto;

a drive means including an engine having an output shaft, said engine being operable independently of said rotor shaft;

electromagnetic clutch means engageable independently of the engine for selectively connecting the other end of the rotor shaft and the engine shaft to one another to drive the compressor from the engine shaft through the rotor shaft; and independent manually operable control means for selectively activating one and only one of the electric motor and the electromagnetic clutch means at a time and for disabling the clutch means from engagement at all times except when the engine is to be operated to drive the compressor.

9. The system of claim 8 wherein the drive means comprises an internal combustion engine having a double-ended output shaft and further including a power utilization device coupled to the engine shaft remotely from the electromagnetic clutch means to be driven by the engine, and separate auxiliary control means for controlling the engine and the motor to operate independently of each other.

10. The system of claim 9 wherein the device comprises a generator for generating electrical power from rotation by the engine shaft.

11. The system of claim 9 wherein the device comprises a pump.

* * * * *